US009120150B2

(12) United States Patent
Lipetzky et al.

(10) Patent No.: US 9,120,150 B2
(45) Date of Patent: Sep. 1, 2015

(54) ENDPLATE FOR HOT ISOSTATIC PRESSING CANISTER, HOT ISOSTATIC PRESSING CANISTER, AND HOT ISOSTATIC PRESSING METHOD

(75) Inventors: Peter Lipetzky, Carnegie, PA (US); Joseph F. Perez, Elizabeth, PA (US); Edward A. Kosol, Bridgeville, PA (US); Jean-Philippe A. Thomas, Charlotte, NC (US)

(73) Assignee: ATI PROPERTIES, INC., Albany, OR (US)

( * ) Notice: Subject to any disclaimer, the term of this patent is extended or adjusted under 35 U.S.C. 154(b) by 653 days.

(21) Appl. No.: 13/309,865

(22) Filed: Dec. 2, 2011

(65) Prior Publication Data

US 2013/0142686 A1 Jun. 6, 2013

(51) Int. Cl.

| | |
|---|---|
| ***B29C 43/02*** | (2006.01) |
| ***B28B 3/00*** | (2006.01) |
| ***B22F 3/12*** | (2006.01) |
| *B22F 3/15* | (2006.01) |
| *C22C 1/04* | (2006.01) |

(52) U.S. Cl.

CPC ..... *B22F 3/1258* (2013.01); *B22F 3/15* (2013.01); *C22C 1/0433* (2013.01)

(58) Field of Classification Search

USPC ..... 425/77, 78, 405.1, 405.2; 419/42, 49, 419/68

See application file for complete search history.

(56) References Cited

U.S. PATENT DOCUMENTS

| | | | | |
|---|---|---|---|---|
| 3,431,597 | A * | 3/1969 | Glesner et al. | 425/112 |
| 3,992,202 | A * | 11/1976 | Dulis et al. | 419/49 |
| 4,544,523 | A | 10/1985 | McCollough et al. | |
| 4,935,198 | A * | 6/1990 | Tornberg | 419/48 |
| 6,309,591 | B1 * | 10/2001 | Yoo et al. | 425/78 |
| 6,623,690 | B1 | 9/2003 | Rizzo et al. | |
| 6,773,824 | B2 | 8/2004 | Rizzo et al. | |
| 7,208,116 | B2 | 4/2007 | Manning et al. | |
| 7,927,085 | B2 | 4/2011 | Hall et al. | |
| 8,303,289 | B2 | 11/2012 | Goller et al. | |

(Continued)

FOREIGN PATENT DOCUMENTS

EP 2286942 A1 2/2011

OTHER PUBLICATIONS

Crucible Compaction Metals P/M Low Carbon Astroloy, Supersolvus, printed from http://www/matweb.com/search/datasheet_print.aspx?matguid=e1bac255c1964e19a43b29 . . . On Aug. 17, 2011, 2 pages.

(Continued)

*Primary Examiner* — Joseph S Del Sole
*Assistant Examiner* — Thukhanh T Nguyen
(74) *Attorney, Agent, or Firm* — John E. Grosselin, III; K&L Gates LLP

(57) ABSTRACT

An endplate for a hot isostatic pressing canister comprises a central region, and a main region extending radially from the central region and terminating in a corner about a periphery of the endplate. The thickness of the endplate increases along the main region, from the central region to the corner, defining a taper angle. The corner includes an inner surface comprising a radiused portion by which the main region smoothly transitions into the lip. A hot isostatic pressing canister including at least one of the endplates also is disclosed, along with a method of hot isostatic pressing a metallurgical powder using the hot isostatic canister.

17 Claims, 11 Drawing Sheets

(56) References Cited

U.S. PATENT DOCUMENTS

| | | | |
|---|---|---|---|
| 2004/0105774 | A1 | 6/2004 | Del Corso et al. |
| 2005/0044800 | A1 | 3/2005 | Hall et al. |

OTHER PUBLICATIONS

Gayda, John, "NASA/TM-2001-210814 High Temperature Fatigue Crack Growth Behavior of Alloy 10", Glenn Research Center, Cleveland, Ohio, National Aeronautics and Space Administration, Apr. 2001, 7 pages.

Advanced Solutions for Higher Performance and Longer Life, ATI Powder Metals Applications, printed from http://www.alleghenytechnologies.com/atipowder/applications/default.asp on Sep. 22, 2011, 4 pages.

* cited by examiner

ENDPLATE FOR HOT ISOSTATIC PRESSING CANISTER, HOT ISOSTATIC PRESSING CANISTER, AND HOT ISOSTATIC PRESSING METHOD

BACKGROUND OF THE TECHNOLOGY

1. Field of the Technology

The present disclosure generally relates to hot isostatic pressing. Certain aspects of the present disclosure relate to canisters and methods for hot isostatic pressing.

2. Description of the Background of the Technology

Hot isostatic pressing, which is often referred to by the shorthand "HIPping", is a manufacturing process for making large powder metallurgy articles, including, but not limited to, large cylinders. HIPping conventionally is used to consolidate metal and metal alloy powders into powder canister forging compacts, which may be cylindrical or have other billet shapes. The HIPping process improves the material's mechanical properties and workability for subsequent forging and other processing.

A typical HIP process includes loading powdered metal and/or powdered metal alloy ("metallurgical powder") into a flexible membrane or a hermitic canister, which acts as a pressure barrier between the powder and the surrounding pressurizing medium. The pressurizing medium may be a liquid or, more commonly, an inert gas such as argon. In HIP processes in which a canister is used, the powder-loaded canister is placed in a pressure chamber and heated to a temperature at which the metallurgical powder inside the canister forms metallurgical bonds. The chamber is pressurized and held at high pressure and temperature. The canister deforms, and the metallurgical powder within the canister is compressed. The use of isostatic pressure ensures a uniform compaction pressure throughout the mass of metallurgical powder, which results in a homogeneous density distribution in the consolidated compact.

A HIPping canister may have a cylindrical shape or any other desired shape suitable for forming the desired compacted shape from metallurgical powder placed in the canister. One conventional HIPping canister design, shown schematically in FIG. 1A as canister 100, includes a cylindrical steel wall and flat or stepped endplates. FIG. 1B is a schematic representation of a cross-section through the central axis of a portion of HIPping canister 100. HIPping canister 100 includes a body portion 102 and flat endplates 104 secured to each end of the body portion 102 by weld beads 106. Fill stems 108 are secured through the endplates 104 and are configured to allow the canister 100 to be filled with the metallurgical powder and allow for air to be evacuated from the canister 100. Once canister 100 is filled with the metallurgical powder and air is evacuated from the canister 100, the canister 100 is sealed. Sealing may be accomplished by crimping the fill stems 108 or by other means isolating the interior of the canister 100 from the external environment. The body portion 102, endplates 104, and fill stems 108 are typically made from mild steel or stainless steel.

Conventional HIPping canister designs have several disadvantages. For example, it is difficult to clean the interior of conventional cylindrical HIPping canisters after assembly. Also, it may not be possible to completely fill the interior of a conventional HIPping canister with metallurgical powder due to the difficulty in moving the powder horizontally after it enters the canister through a fill stem. Certain HIPping canisters designs include multiple fill stems to improve canister filling and enhance degassing efficiency. Including additional fill stems, however, adds cost, provides additional points of possible canister failure during HIP, and typically has only a small effect on increasing vacuum degassing efficiency. Welds securing fill stems through the endplates (and securing the endplates to the canister body) are under extreme stress during HIP consolidation due to locally high distortion, and including multiple fill stems to address powder fill problems increase the risk of weld failure during HIP consolidation. Also, conventional canister designs including multiple fill stems must be inverted during HIPping to ensure that all stems are filled with metallurgical powder and to prevent stem collapse during consolidation, and this procedure increases risk to personnel and creates an opportunity for part damage.

Accordingly, there is a need for an improved HIPping canister design. Such a design preferably addresses powder filling problems associated with conventional canister designs, but without a requirement for including additional fill stems on the canister.

SUMMARY

One non-limiting aspect of the present disclosure is directed to an endplate of a HIPping canister. The endplate comprises a central region and a main region extending radially from the central region and terminating in a corner about a periphery of the endplate. The corner includes a peripheral lip configured to mate with a body portion of the canister. The thickness of the endplate increases from the central region to the corner and defines a taper angle. An inner surface of the corner includes a radiused portion by which the main region smoothly transitions into the lip.

Another non-limiting aspect of the present disclosure is directed to a canister for HIPping a powdered material. The HIPping canister comprises a cylindrical body portion including a circular first end and a circular second end. A first endplate is welded to the circular first end of the body portion. A second endplate is welded to the circular second end of the body portion. The first endplate comprises a central region and a main region extending radially from the central region and terminating in a corner about a periphery of the first endplate. The corner includes a peripheral lip configured to mate with the circular first end of the body portion of the canister. The thickness of the first endplate increases from the central region to the corner and defines a taper angle. An inner surface of the corner includes a radiused portion by which the main region smoothly transitions into the lip. The first endplate further comprises a fill stem therethrough through which powder may be introduced into an interior volume of the HIPping canister.

Yet another non-limiting aspect of the present disclosure is directed to a method for HIPping a powdered material. The method comprises providing a HIPping canister comprising a cylindrical body portion including a circular first end and a circular second end. A first endplate is welded to the circular first end of the body portion. A second endplate is welded to the circular second end of the body portion. The first endplate comprises a central region and a main region extending radially from the central region and terminating in a corner about a periphery of the first endplate. The corner includes a peripheral lip configured to mate with the circular first end of the body portion of the canister. The thickness of the first endplate increases from the central region to the corner and defines a taper angle. An inner surface of the corner includes a radiused portion by which the main region smoothly transitions into the lip. The first endplate further comprises a fill stem therethrough through which powder may be introduced into an interior volume of the HIPping canister. At least one metallurgical powder is introduced into the interior volume of the HIPping canister through the fill stem. Air is evacuated from the interior volume of the HIPping canister through the fill stem. The fill stem is crimped to hermetically seal the interior volume from the external atmosphere, and the HIPping canister is hot isostatically pressed.

A further non-limiting aspect of the present disclosure is directed to a billet formed by HIPping a metallurgical powder. The HIPped billet comprises at least one substantially flat end face formed during HIPping. The substantially flat end face reduces or eliminates the need to machine the billet end face after HIPping. In one non-limiting embodiment, the billet comprises a nickel-base superalloy.

BRIEF DESCRIPTION OF THE DRAWINGS

The features and advantages of methods and articles of manufacture described herein may be better understood by reference to the accompanying drawings in which.

Figure 1A:
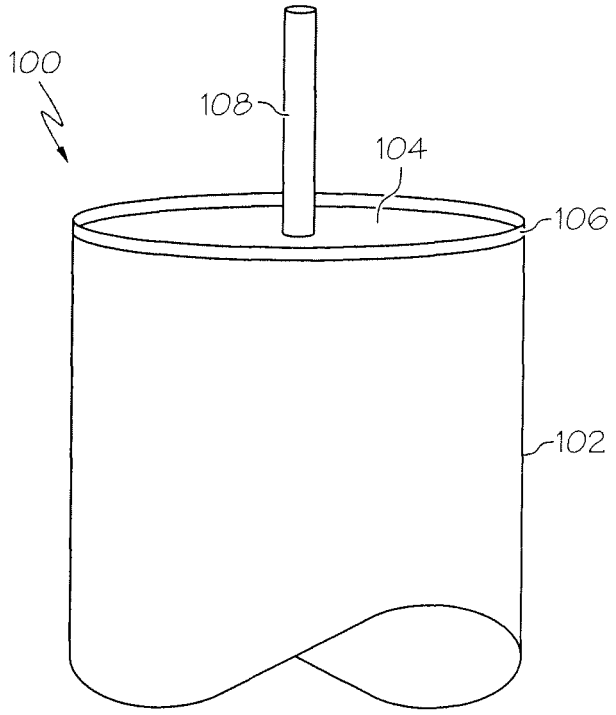
FIG. 1A (PRIOR ART)
FIG. 1A is a schematic representation of a conventional cylindrical HIPping canister including flat endplates.

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

It is to be understood that certain descriptions of the embodiments disclosed herein have been simplified to illustrate only those elements, features, and aspects that are relevant to a clear understanding of the disclosed embodiments, while eliminating, for purposes of clarity, other elements, features, and aspects. Persons having ordinary skill in the art, upon considering the present description of the disclosed embodiments, will recognize that other elements and/or features may be desirable in a particular implementation or application of the disclosed embodiments. However, because such other elements and/or features may be readily ascertained and implemented by persons having ordinary skill in the art upon considering the present description of the disclosed embodiments, and are therefore not necessary for a complete understanding of the disclosed embodiments, a description of such elements and/or features is not provided herein. As such, it is to be understood that the description set forth herein is merely exemplary and illustrative of the disclosed embodiments and is not intended to limit the scope of the invention as defined solely by the claims.

In the present description of non-limiting embodiments, other than in the operating examples or where otherwise indicated, all numbers expressing quantities or characteristics are to be understood as being modified in all instances by the term "about". Accordingly, unless indicated to the contrary, any numerical parameters set forth in the following description are approximations that may vary depending on the desired properties one seeks to obtain in the subject matter according to the present disclosure. At the very least, and not as an attempt to limit the application of the doctrine of equivalents to the scope of the claims, each numerical parameter provided herein should at least be construed in light of the number of reported significant digits and by applying ordinary rounding techniques.

Also, any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10. Any maximum numerical limitation recited herein is intended to include all lower numerical limitations subsumed therein and any minimum numerical limitation recited herein is intended to include all higher numerical limitations subsumed therein. Accordingly, Applicants reserve the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. §112, first paragraph, and 35 U.S.C. §132(a).

The grammatical articles "one", "a", "an", and "the", as used herein, are intended to include "at least one" or "one or more", unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

The present disclosure includes descriptions of various embodiments. It is to be understood that all embodiments described herein are exemplary, illustrative, and non-limiting. Thus, the invention is not limited by the description of the various exemplary, illustrative, and non-limiting embodiments. Rather, the invention is defined solely by the claims, which may be amended to recite any features expressly or inherently described in or otherwise expressly or inherently supported by the present disclosure.

Figure 2:
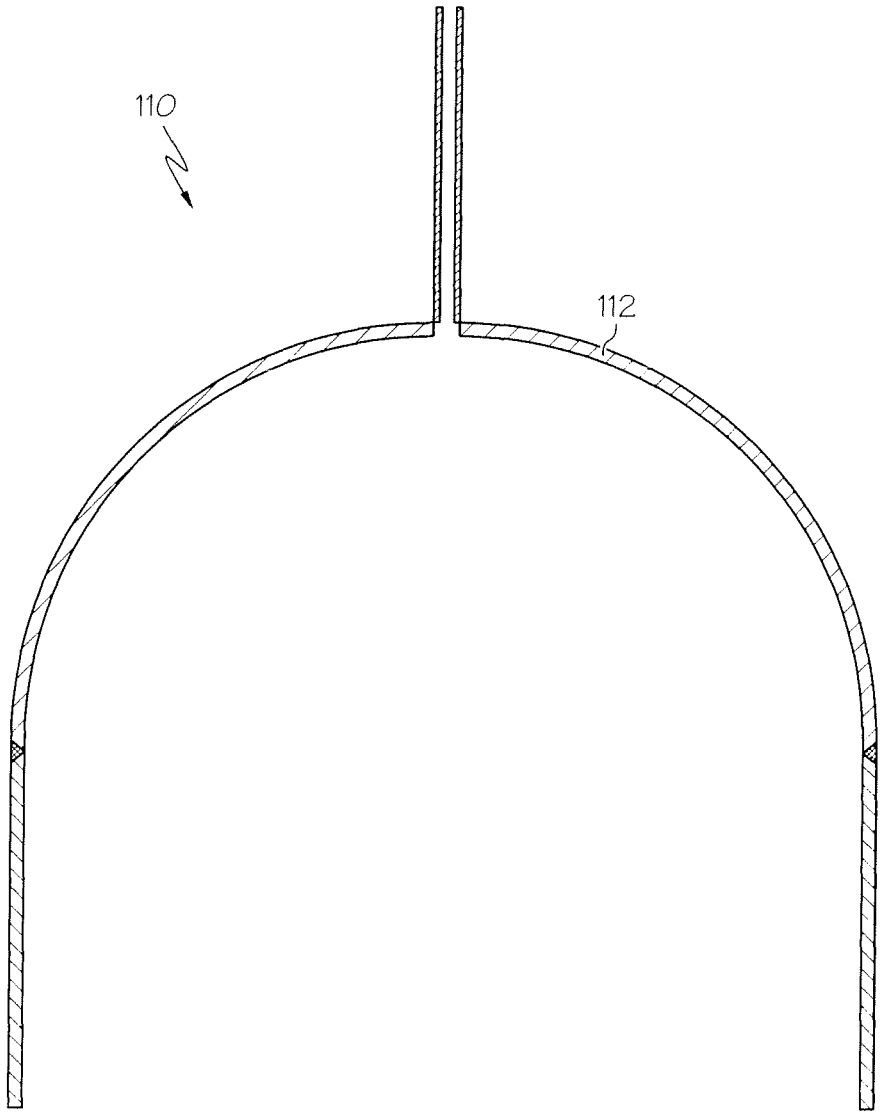
FIG. 2 (PRIOR ART)
FIG. 2 is a schematic representation of a cross-section of a region of a HIPping canister including an arched endplate.

As discussed above, conventional HIPping canister designs have several disadvantages. In addition to difficulties during the HIPping process associated with conventional canister designs, there may be disadvantages to the billets formed using conventional HIPping canisters. For example, it may be difficult to successfully forge certain nickel-base superalloy billets made by HIPping due to strain rate sensitivity cracking of the billets. The present inventors observed that the billet cracking during forging originated at sharp corners on the billet formed adjacent regions of the HIPping canister in which an endplate transitioned into the body portion of the canister. Providing an arched or dome-shaped endplate may reduce the incidence of this cracking phenomenon. FIG. 2 is a schematic representation of a cross-section taken through an exemplary HIPping canister 110 including a dome-shaped endplate 112. The present inventors determined that because of the high strength of dome-shaped endplates, the dome does not flatten during HIPping, which prevents the end face of the consolidated compact from acquiring a flat surface, and results in a convex end face on the consolidated billet. After HIPping, subsequent processing steps, such as forging, require billets that have flat end faces. Therefore, the convex end faces must be machined flat. This results in a high loss of material, which may be tolerable for the HIPping of less expensive steel alloys, but can be costly in the case of nickel-base superalloys and other highly expensive alloys. In addition, the fabrication of dome-shaped endplates is expensive due to the amount of blank endplate material required and the associated machining costs.

During the HIPping process, metallurgical power is consolidated and densified to full density through application of high temperature and isostatic pressure. The HIPping canister collapses during consolidation. Although the strain on the canister during HIPping is generally uniform, certain regions of the canister, such as corners, are under greater stress and highly localized strain. If, for example, the interior volume of a HIPping canister is not completely filled with metallurgical powder in a corner region where an endplate transitions into the body portion of the canister, the degree of localized strain in the region can be severe and may cause weld failure and resultant incomplete densification of the metallurgical powder.

Figure 3:
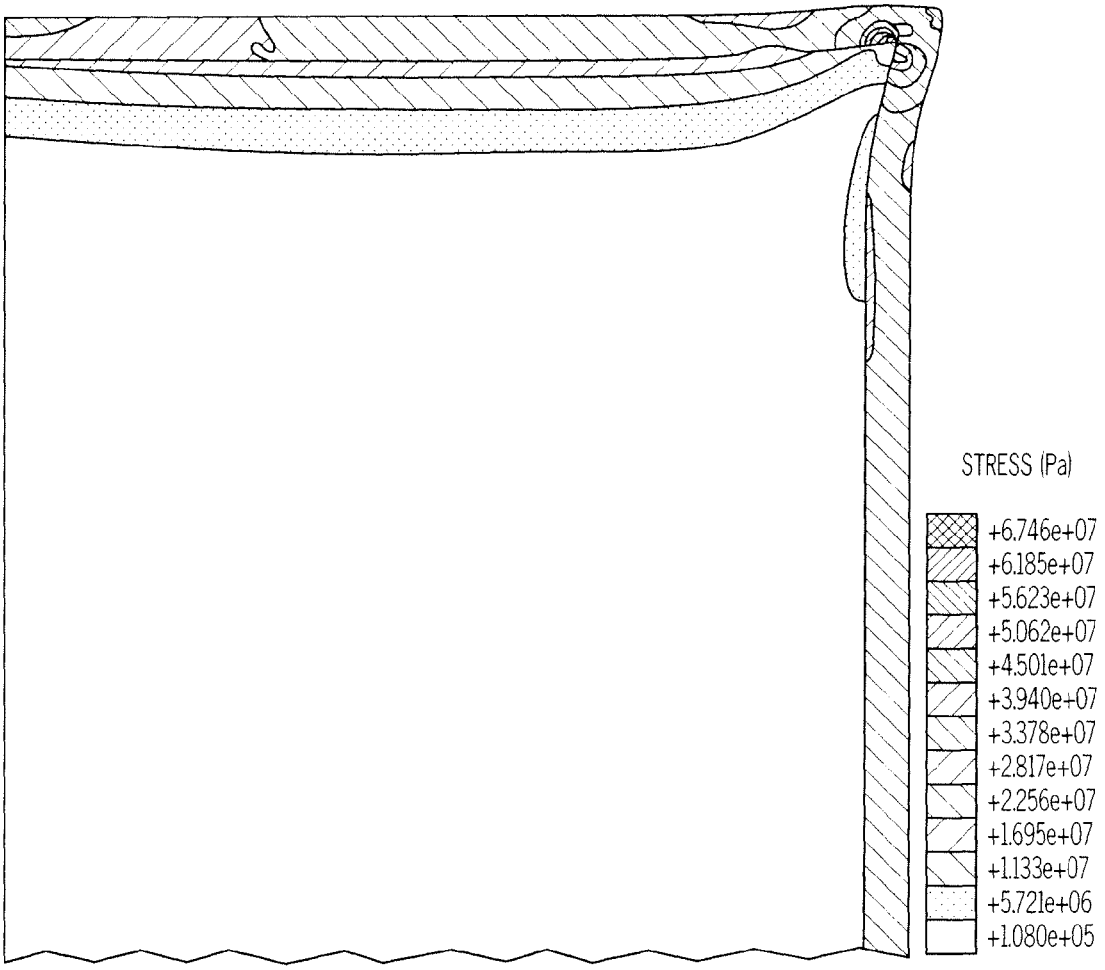
FIG. 3 (PRIOR ART)
FIG. 3 is a representation of stresses generated during HIPping in a region of a metallurgical powder-filled HIPping canister including a conventional flat endplate.

FIG. 3 is a representation of calculated stress levels (in units of Pascals) experienced during HIPping for a region of a metallurgical powder-filed cylindrical HIPping canister including a conventional flat top endplate. FIG. 3 shows that the corner region of the flat endplate, where the endplate mates with a circular end of the body portion of the canister, experiences high stress levels and highly localized strain. The figure further shows that the high stresses experienced by the corner region are transferred to areas in the corner of the billet formed in the canister during HIPping. The stresses to which the corners of the consolidated billet are subjected during HIPping may produce a billet that fractures during upset forging or other post-consolidation processing.

Figure 4A:
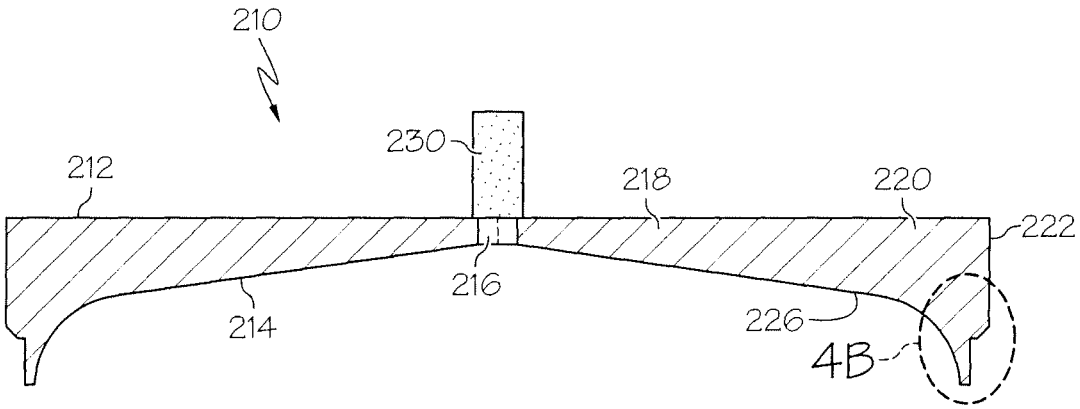
FIG. 4A is a schematic representation of a cross-section of a non-limiting embodiment of a tapered endplate for a HIPping canister according to the present disclosure.

An aspect of the present disclosure is directed to a HIPping canister endplate design that may reduce the stress concentration in the corner regions of the HIPping canister as the canister deforms during HIPping. FIG. 4A is a schematic representation of a cross-section through the center of a circular endplate 210 according to a non-limiting embodiment of the present disclosure. Endplate 210 comprises an outer face 212 and an inner face 214. The inner face 214 forms a region of the internal surface of the HIPping canister to which the endplate 210 is secured. The outer face 214 forms a region of the exterior surface of the HIPping canister. Endplate 210 also comprises central region 216, which in certain non-limiting embodiments has a generally uniform thickness (i.e., in the embodiment, the distance between the outer face 212 and the inner face 214 is generally uniform in the central region 216). In certain non-limiting embodiments, the uniform thickness of the central region 216 may be in a range of about 0.25 inch to about 1 inch, or about 0.5 inches. In certain non-limiting embodiments, the diameter of the central region 216, as measured along the outer face 212, may be in a range of about 0.25 inch to about 1 inch, or about 0.5 inches. In certain non-limiting embodiment, the central region 216 may include a bore through the endplate 210, passing between the outer face 212 and the inner face 214 and allowing access into the interior volume of the HIPping canister.

Still referring FIG. 4A, endplate 210 further includes a main region 218 extending radially from the central region 216 and terminating in a corner 220 that extends entirely about the circular periphery 222 of the circular endplate 210. In certain non-limiting embodiments, the diameter of the outer face 212 of the endplate 210 may be in a range of about 1 inch to about 30 inches, or in a range of about 5 inches to about 25 inches, or about 20.6 inches. As shown in FIG. 4A, a thickness of the endplate 210 increases from the central region 216 through the main region to the corner 220. The increasing thickness of the endplate 210 in the main region 218 as the distance from the center of the endplate 210 increases defines a taper angle θ. In certain non-limiting embodiments of endplate 210, the taper angle may be in a range of about 3° to about 15°, or about 5° to about 10°, or about 8°. In the non-limiting embodiment of endplate 210 shown in FIG. 4A, the outer face 212 is substantially planar and the taper angle is formed by a downward sloping of the inner face 214 away from the outer face 212 in the direction of the periphery 222.

Figure 4B:
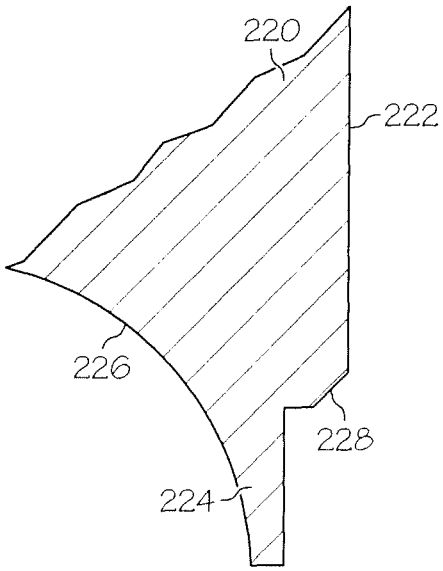
FIG. 4B is a detailed representation of the corner region of the tapered endplate shown in FIG. 4A.
Figure 5:
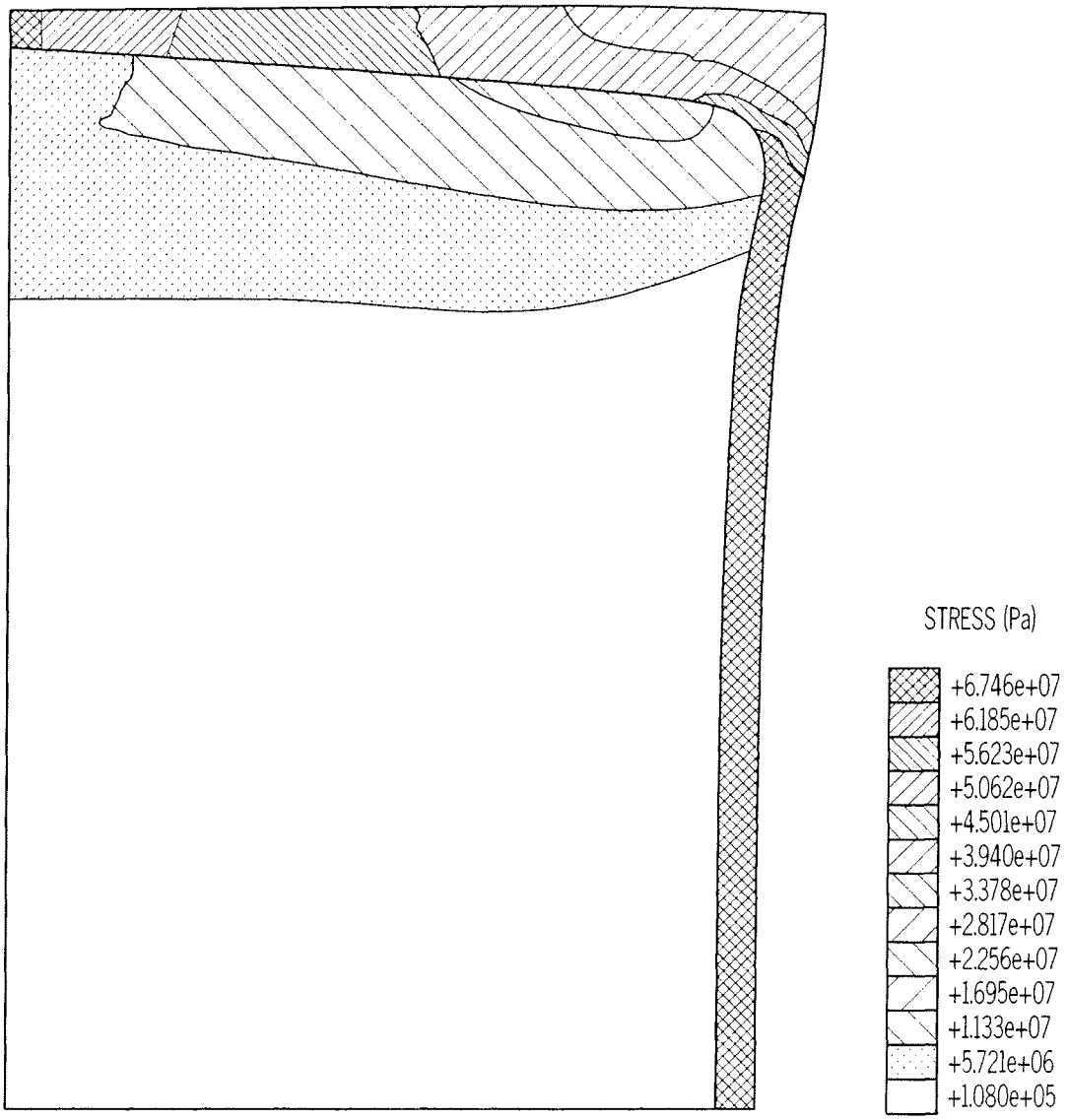
FIG. 5 (PRIOR ART)
FIG. 5 is a representation of stresses generated during HIPping in a region of an embodiment of a tapered endplate for a HIPping canister according to the present disclosure.

Referring now to FIGS. 4A and 4B, the corner 220 includes a peripheral lip 224 having a shape configured to mate with a circular face of a cylindrical body portion (not shown) of the HIPping canister. The corner 220 includes a radiused inner surface region 226 by which the main region 218 smoothly transitions (i.e., transitions without sharp edges or corners) into the peripheral lip 224. In certain non-limiting embodiments of endplate 210, the radiused inner surface region 226 may have a circular cross-section having a radius in a range of about 0.5 inches to about 3.0 inches, or about 2.0 inches. It will be understood, however, that the radius of the inner surface region 226 will generally depend on the size of the HIPping canister. The radiused inner surface region 226 of the corner 220 acts to spread the stress that occurs in the corner region over the endplate and to the vertical wall of the canister, as shown in FIG. 5 and as discussed further hereinbelow. Otherwise, the consolidated billet may include a sharp corner having high residual stresses. The portion of a HIP billet end face including a sharp corner must be machined away prior to forging or other processing of the billet, resulting in the waste of expensive alloy material.

With regard to an HIPping canister endplate according to the present disclosure, it will be understood, that the radiused inner surface region 226 need not have a circular cross-section and may have any cross-sectional shape that smoothly transitions from the main region 218 into the peripheral lip 224 and spreads out the stresses experienced in the corner 220 during HIPping. Non-limiting examples of other possible cross-sectional shapes for the curved inner surface region 226 include, for example, rounded and elliptical shapes.

In a non-limiting embodiment according to the present disclosure, the peripheral lip 224 of the endplate 210 includes a chamfer 228 that extends around the periphery of the endplate 210. The chamfer 228 is configured to accept a weld bead (not shown) securing the endplate 210 to the body portion (not shown) of the HIPping canister. In a non-limiting embodiment, the chamfer 228 comprises a chamfer width in a range if about 0.125 inch to about 0.25 inch and is angled relative to an axis of the endplate 210 so as to form a chamfer angle in a range of about 30° to about 60°, or about 45°.

In one non-limiting embodiment according to the present disclosure, the endplate 210 further comprises at least one fill stem 230. The at least one fill stem 230 is configured to allow powdered materials to be introduced into an interior volume of a HIPping canister to which the endplate 210 is secured. The fill stem 230 also allows gases to be removed from the interior volume of the HIPping canister prior to HIP consolidation. In a non-limiting embodiment, a single fill stem 230 is welded to the periphery of a bore formed through the central region 216 of the endplate 210. It will be understood that although a single fill stem 230 is shown in FIG. 4A in a central region of endplate 210, one or more fill stems can be located at other positions on the endplate, and a fill stem need not be included in a central position on the endplate. Each such fill stem should provide fluid communication with the interior volume of the HIPping canister to which the endplate is secured.

In a non-limiting embodiment of endplate 210, the endplate 210 includes only a single fill stem 230. Multiple fill stems are commonly used on conventional endplates to improve the efficiency of filling the canister with metallurgical powder. Metallurgical powder tends to remain in a conical configuration during vibratory loading of a canister with the powder. Because of this tendency, it is difficult to cause metallurgical powder introduced into a HIPping canister through a fill stem to move outward in a horizontal direction and thereby fill all regions of the canister. Endplate 210, which is designed to include a taper angle, improves the likelihood of completely filling an interior volume of a HIPping canister with metallurgical powder. The radiused portion of the inner surface region 226 of the corner 220 of the endplate 210 also helps to better ensure complete filling of the interior volume with metallurgical powder. The tapered design and radiused inner surface region of endplate 210 promote the flow of metallurgical powder to the outside edges of the interior volume of the HIPping canister and better ensure that there are no gaps between the metallurgical powder and the internal walls of the canister.

Including only a single fill stem on the HIPping canister, such as single fill stem 230 of endplate 210, eliminates the need to flip the canister during filling or HIPping. A single fill stem canister design can utilize an intrusive rod for metallurgical powder location measurements. With conventional multiple-stem HIPping canister endplates, this may not be possible, and the canister must be physically inverted prior to HIPping. Inverting large HIPping canisters filled with metallurgical powder is difficult due to canister weight and risks canister damage. In addition, each fill stem necessarily is an additional point of penetration into the canister and is an additional point of possible canister failure during pressurization in the HIP process.

The present inventors have discovered that an endplate design including a tapered construction, such as included in, for example, endplate 210, provides possible additional benefits. One such benefit is the possible improvement of as-HIP yield. Using a HIPping canister including a conventional flat endplate yields a HIP billet having a concave end surface, which must be machined to a flat surface prior to forging. Embodiments of endplates according to the present disclosure may yield billets having a flat end face, or at least a flatter (less concave) end face than billets produced using a conventional flat endplate. Therefore, use of embodiments of the endplate and canister designs contemplated herein can reduce or eliminate the need for post-HIP machining to provide flat end surfaces on the HIP billet prior to upset forging. Reducing the need for post-HIP machining reduces costs and time, and also may eliminate the need for a processing step that can result in part failure. Endplate designs herein also may add strength to the corner region of the HIP billet because consolidation involves more side-face movement than using flat endplates.

Use of embodiments of the endplate and canister designs contemplated herein including a tapered inner face and a corner including a radiused inner surface also may improve internal cleanliness of the canister. Specifications for powder metallurgy products may necessitate extreme cleanliness of the HIPping canister's internal surfaces during the HIPping process. It has been found that certain endplate designs as disclosed herein facilitate drainage from the interior volume of the canister during cleaning and water or powder purging.

Endplates for HIPping canisters typically are electropolished prior to use to improve the cleanliness of the final part. It has been observed that endplate design embodiments contemplated herein including a tapered inner face and a corner including a radiused inner surface may be more evenly electropolished. Thus, the tapered and radiused internal surfaces of certain embodiments of endplates according to the present disclosure improve canister cleanliness and enhance processing efficiency.

An additional advantage of certain endplate embodiments according to the present disclosure is that the design including tapered and radiused surfaces reduces the concavity of the end surfaces during HIP consolidation. The tapered dome shape and round corner of the endplate adds strength to the corner region and consolidation involves more side-face movement. The resulting flat-end consolidated billet is readily upset forged during subsequent forming operations.

Figure 1B:
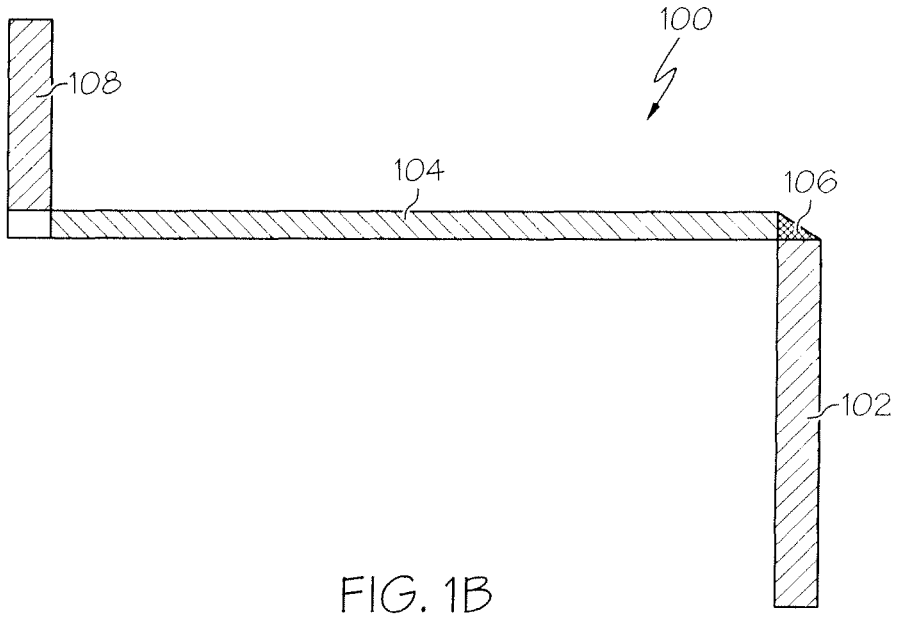
FIG. 1B (PRIOR ART)
FIG. 1B is a schematic representation of a cross-section of a region of the conventional cylindrical HIPping canister of FIG. 1A, wherein the cross-section is taken along the longitudinal axis and through a portion of an endplate and the body portion of the canister.

It also has been determined that the radiused inner surface of the corner of certain endplate embodiments according to the present disclosure, such as endplate 210, reduces stress concentrations on the weld joint between the endplate and the body portion of the HIPping canister during HIP consolidation. As shown in FIGS. 1A and 1B, the corner of conventional flat endplates typically is welded directly to the end of the body portion of the HIPping canister. As shown in FIG. 3, the weld seam in the conventional design is a stress concentrator, which can result in rupturing of the weld and breaching of the canister during vibratory loading of the HIPping canister or subsequently during HIP consolidation.

FIG. 5 is a representation showing the calculated stresses experienced by a HIPping canister including an endplate constructed in the manner of endplate 210. FIG. 5 shows that the stresses at the radiused corner of the endplate are not concentrated, but rather are generally spatially distributed relative to the stress concentration seen at the corner for the conventional flat endplate considered in FIG. 3. In addition, high levels of stress are not concentrated around the weld seam (located on the peripheral edge in the chamfer region of the endplate) in the embodiment considered in FIG. 5. Accordingly, it is contemplated that an endplate embodiment according to the present disclosure including a tapered inner face and a corner including a radiused inner surface can: reduce stress concentration at the corner of the endplate, instead distributing stress into the consolidated billet; reduce stress concentration in the region of the weld seam between the endplate and the canister body portion; and provide a HIP billet having a flat or flatter end face, eliminating or reducing the need for pre-forge machining to provide flat end faces on the billet.

In non-limiting embodiments, an endplate according the present disclosure consists of or comprises low carbon steel, mild steel, or stainless steel. In a specific embodiment, an endplate according to the present disclosure is fabricated from AISI T-304 stainless steel (UNS S30400). In other non-limiting embodiments, an endplate according to the present disclosure consists of or comprises a nickel base superalloy, such as, but not limited to, an alloy selected from Alloy 600 (UNS N06600), Alloy 625 (UNS N06625), and Alloy 718 (UNS N07718). It will be understood, however, that an endplate according to the present disclosure may be made from any metal or metallic alloy compatible with the metallurgical powder to be included in the HIPping canister and having properties suitable for use in the HIPping process. In a non-limiting embodiment, at least a portion of the endplate is electropolished and has an electropolished finish, which may facilitate powder filling and improve cleanliness of the interior volume of the HIPping canister. In still another non-limiting embodiment, an endplate according to the present disclosure exhibits a surface roughness of about or no greater than 125 RMS (root mean square). Any technique useful for reducing surface roughness of the inner surfaces of the endplate may enhance powder filling and/or cleanliness of the interior volume of the canister.

Endplates constructed according to the present disclosure may be generally circular and configured to fit a cylindrical body portion of a HIPping canister. However, it will be understood that the endplates according to the present disclosure can be of any shape designed to fit the body portion of the HIPping canister to be provided. Regardless of overall shape, any such endplate embodiment according to the present disclosure will embody the tapered inner face and/or corner radiused inner surface features described herein.

Figure 6:
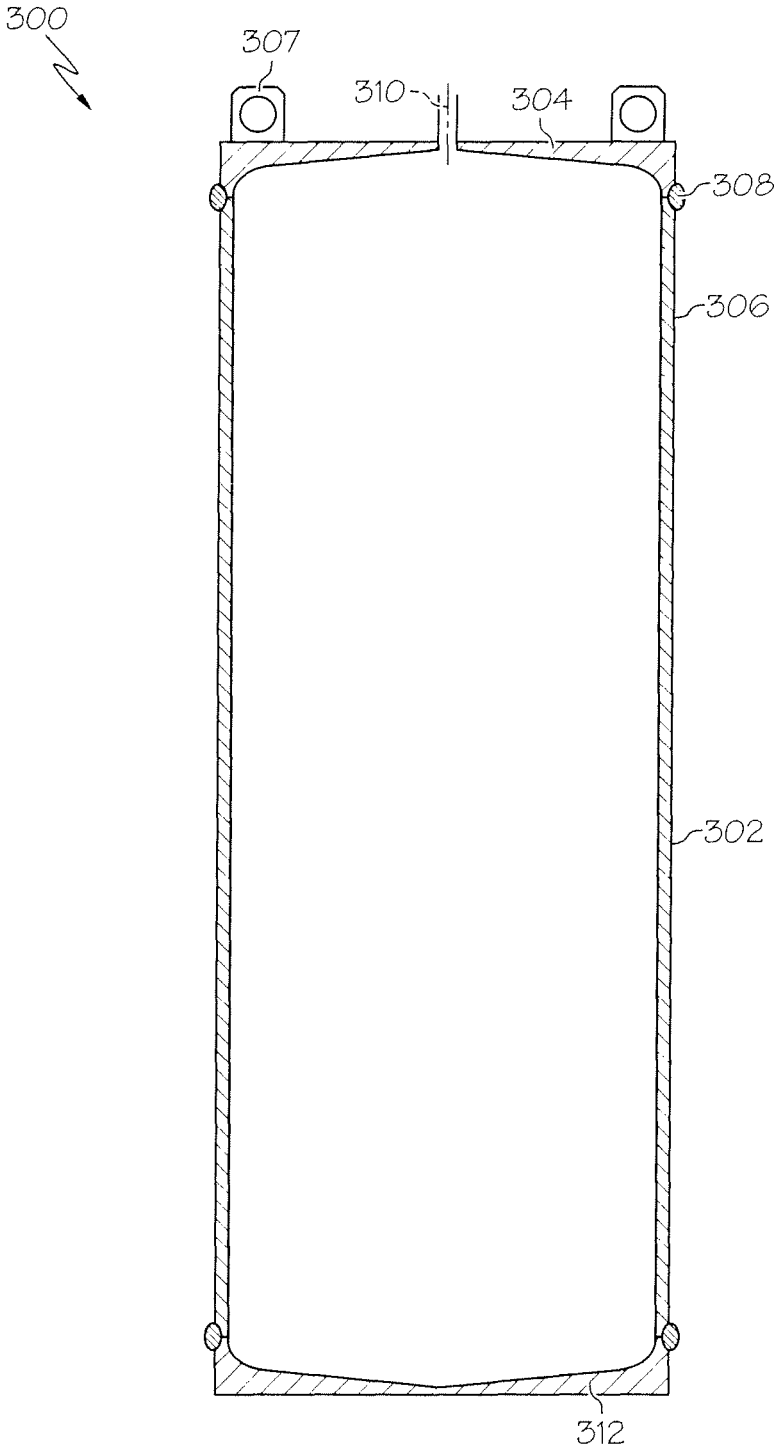
FIG. 6 is a schematic representation of a cross-section of a non-limiting embodiment of a HIPping canister according to the present disclosure.

Referring now to FIG. 6, another aspect of the present disclosure is directed to a canister for hot isostatic pressing a powdered material. FIG. 6 depicts a cross-section of a non-limiting embodiment of a HIPping canister 300 according the present disclosure. Canister 300 comprises a body portion 302, which may have, for example, a cylindrical shape or any other suitable shape. Canister 300 comprises a first endplate 304 constructed according to the present disclosure to include a tapered inner face and a corner including a radiused inner surface as described herein. Endplate 304 is welded to a circular first end 306 of the body portion 302. The endplate 304 may have, for example, the design of endplate 210 shown in FIGS. 4A and 4B, which is described above. Endplate 304 may include at least one lift lug 307 configured to expedite lifting and moving of the canister 300.

Referring now to FIGS. 4A, 4B, and 6, HIPping canister 300 includes endplate 304 which, with reference to FIGS. 4A and 4B, comprises an outer face 212, an inner face 214, and a central region 216. In a non-limiting embodiment, the central region 216 may have a uniform thickness. In specific non-limiting embodiments, the uniform thickness of the central region 216 may be in a range of about 0.25 inch to about 1.00 inch, or about 0.5 inches. In non-limiting embodiments, the diameter of the central region 216 may be in a range of about 0.25 inch to about 1 inch, or about 0.5 inches. In another non-limiting embodiment, the central region 216 may define a bore in the endplate. In a non-limiting embodiment, the first endplate 304 may be circular in shape to mate with a circular end of a cylindrical body portion 302 of a HIPping canister 300. However, as discussed above, endplates according to the present disclosure may have any general shape suitable to mate with the shape of the particular body portion of the HIPping canister.

Still referring to the non-limiting embodiment of FIGS. 4A, 4B, and 6, first endplate 210, 304 further includes a main region 218 extending radially from the central region 216 and terminating in a corner 220 about a circular periphery 222 of the endplate. According to a non-limiting embodiment, the first endplate 304 may have a diameter in a range of about 1.0 inch to about 30 inches, or in a range of about 5 inches to about 25 inches, or about 20.6 inches. The outer face 212 is substantially planar, but a thickness of the endplate 210 increases from the central region 216 to the corner 220 and thereby defines a taper angle θ. In non-limiting embodiments, the taper angle may be in a range of about 3° to about 15°, or in a range of about 5° to about 10°, or about 8°. The corner 220 includes a peripheral lip 224 configured to mate with a circular first end of the body portion 302. The corner 220 includes an inner surface 226 that is radiused so as to smoothly transition between the main region 218 and the peripheral lip 224. In non-limiting embodiments, the radiused portion is a circular radius of about 0.5 inches to about 3.0 inches, or about 2.0 inches.

In a non-limiting embodiment according to the present disclosure, the peripheral lip 224 of the endplate 210, 304 includes a chamfer 228. The chamfer 228 is configured to accept a weld bead 308 for welding the endplate 210, 304 to the body portion 302 of a hot isostatic pressing canister 300. In a non-limiting embodiment, the chamfer 228 may comprise a chamfer length in a range of about 0.125 inch to about 0.25 inch, and a chamfer angle in a range of about 30° to about 60°, or about 45°.

In non-limiting embodiments, an endplate, fill stem, and canister body portion according the present disclosure consists of or comprises low carbon steel, mild steel, or stainless steel. In a specific embodiment, an endplate, fill stem, and canister body portion according to the present disclosure is fabricated from AISI T-304 stainless steel (UNS S30400). In other non-limiting embodiments, an endplate, fill stem, and canister body portion according to the present disclosure consists of or comprises a nickel base superalloy, such as, but not limited to Alloy 600 (UNS N06600), Alloy 625 (UNS N06625), or Alloy 718 (UNS N07718). It will be understood, however, that an endplate, fill stem, and canister body portion according to the present disclosure may be made from any metal or metallic alloy compatible with the metallurgical powder to be included in the HIPping canister and having properties suitable for use in the HIPping process.

Figure 7:
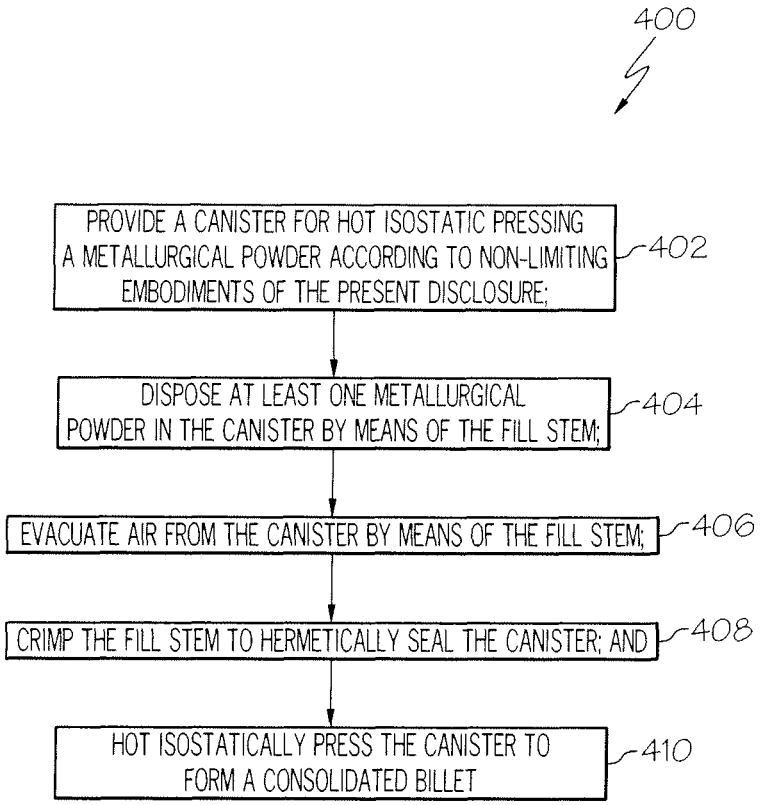
FIG. 7 is a flow diagram of steps of a non-limiting embodiment of a HIPping method according to the present disclosure.

Referring to the flow diagram of FIG. 7, an additional aspect of the present disclosure is directed to a method 400 for hot isostatic pressing a metallurgical powder. The method comprises providing 402 a HIPping canister having a design according to the present disclosure. For example, the HIPping canister may have the design shown in FIG. 6, described above. In one non-limiting embodiment, the HIPping canister may include a cylindrical body portion including a circular first end and a circular second end. A first endplate is welded to the circular first end of the cylindrical body portion. The first endplate includes a central region, and a main region extending radially from the central region and terminating in a corner about a periphery of the endplate, wherein the corner includes a peripheral lip configured to mate with a body portion of the canister. A thickness of the endplate increases from the central region to the corner and defines a taper angle, and an inner surface of the corner includes a radiused portion by which the main region smoothly transitions into the peripheral lip. A fill stem is attached to the first endplate and is configured to enable fluid communication with an interior volume of the canister. A second endplate is welded to the circular second end of the cylindrical body portion. Again referring to FIG. 7, the method 400 further comprises disposing 404 at least one metallurgical powder, such as, for example, a nickel-base superalloy powder, in the canister through the fill stem. Air is evacuated 406 from the canister through the fill stem. After sufficient air is evacuated from the canister, the fill stem is crimped 408, or otherwise sealed, to hermetically seal the canister. The metallurgical powder in the air-evacuated canister is hot isostatically pressed 410 in a conventional manner to provide a hot isostatic pressed billet.

Figure 8:
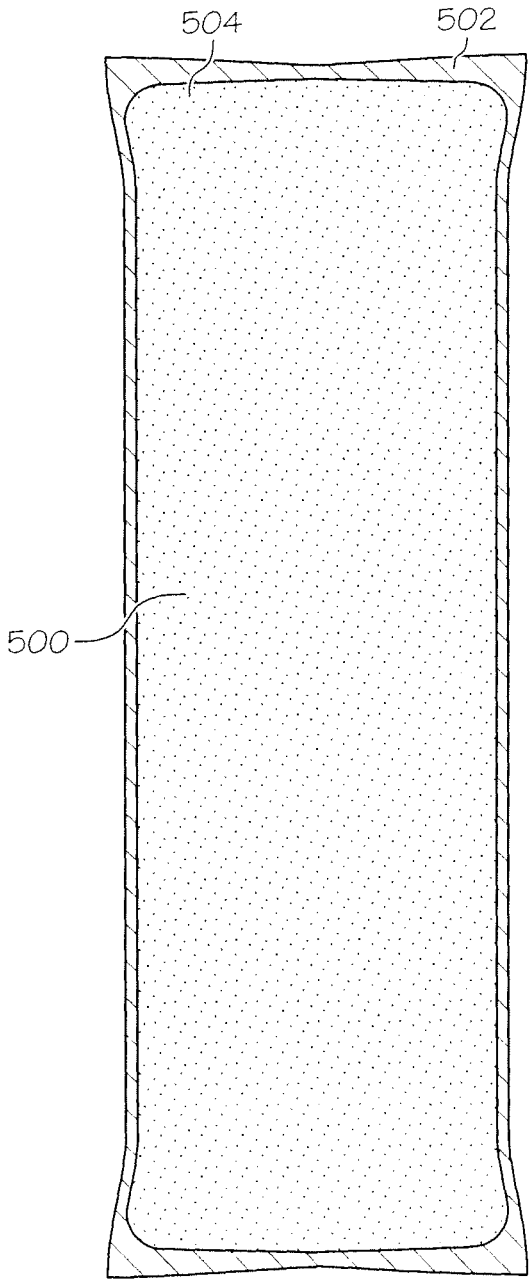
FIG. 8 is a schematic representation of a cross-section of a non-limiting embodiment of a canned billet including substantially flat end faces formed by HIPping a metallurgical powder according to the present disclosure.

Now referring to the non-limiting schematic example shown in FIG. 8, still another aspect according to the present disclosure is directed to a hot isostatically pressed powder metal part or billet 500 manufactured according to non-limiting embodiments of methods according to the present disclosure. FIG. 8 depicts a cross-section of the billet 500 still encased in a deformed canister 502 according to the present disclosure. The billet 500 comprises at least one substantially flat end face 504. In non-limiting embodiments, the hot isostatically pressed powder metal billet 500 comprises a nickel-base superalloy. After removal of the canister 502 by machining and/or acid pickling, for example, the billet 500 requires little or no further machining to present a flat end face 504 prior to upset forging or other processing of the billet. In another non-limiting embodiment, the hot isostatically pressed powder metal billet 500 comprises one of a Rolls Royce RR1000 alloy, an Alloy 10 alloy, and a low carbon ASTROLOY alloy, the compositions of which are known to those having ordinary skill in the metallurgy field. As is known in the art, RR1000 alloy has the following nominal composition, in percent by weight: 55 Ni, 14.5 Cr, 16.5 Co, 4.5 Mo, and balance Ni. Alloy 10 is disclosed in U.S. Pat. No. 6,890,370, which is herby incorporated by reference herein in its entirety. Alloy 10 alloy has the following compositional range, in percent by weight: 14.0-18.0 Co, 10.0-11.5 Cr, 3.45-4.15 Al, 3.60-4.20 Ti, 0.45-1.5 Ta, 1.4-2.0 Nb, 0.03-0.04 C, 0.01-0.025 B, 0.05-0.15 Zr, 2.0-3.0 Mo, 4.5 W+Re, and balance Ni. In a preferred embodiment, the ratio of Mo/(W+Re) for Alloy 10 is in the range of 0.25 to 0.5. In another embodiment, when Alloy 10 does not contain rhenium, the ratio of Mo/W is in the range of about 0.25 to about 0.5. As is known in the art, low carbon ASTROLOY alloy has the following composition, in percent by weight: 3.85-4.14 Al, 0.015-0.0235 B, 0.020-0.040 C, 14.0-16.0 Cr, 16.0-18.0 Co, 4.50-5.50 Mo, 52.6-58.3 Ni, and 3.35-3.65 Ti.

The examples that follow are intended to further describe certain non-limiting embodiments, without restricting the scope of the present invention. Persons having ordinary skill in the art will appreciate that variations of the following examples are possible within the scope of the invention, which is defined solely by the claims.

Example 1

Figure 9A:
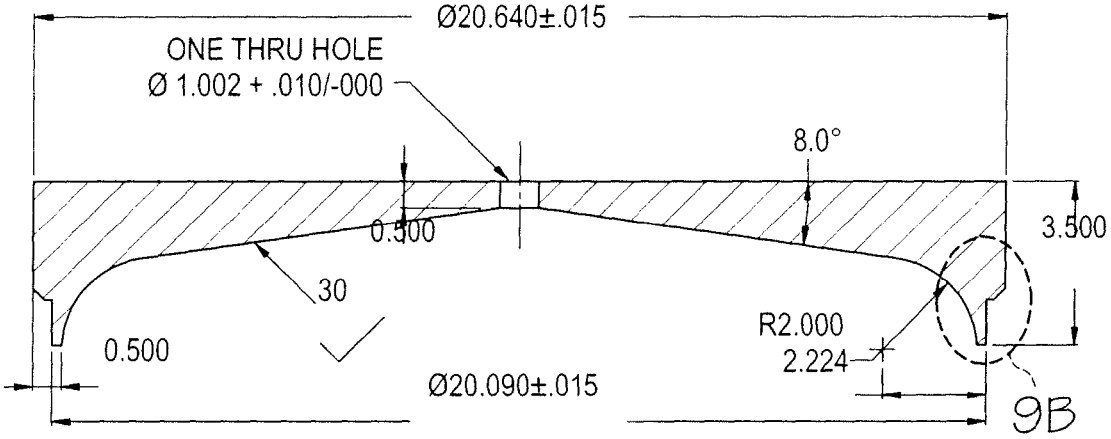
FIG. 9A is a detailed schematic representation of a cross-section of a non-limiting embodiment of a circular AISI T-304 stainless steel endplate for a HIPping canister according to the present disclosure.
Figure 9B:
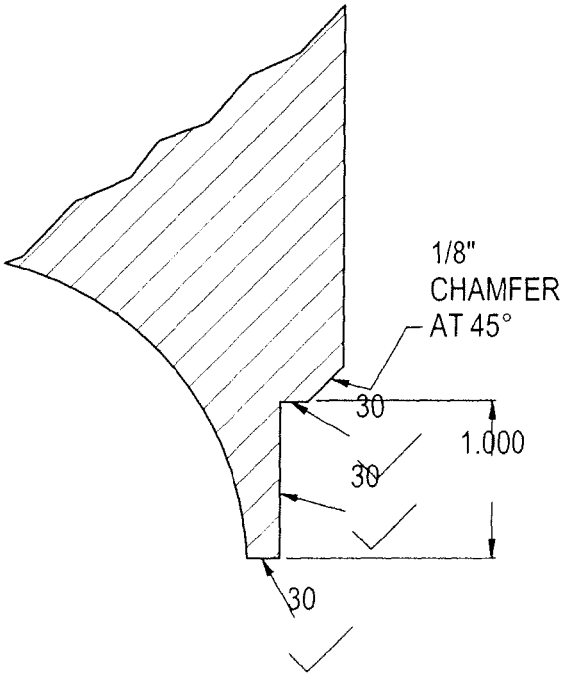
FIG. 9B is an enlarged view of the section encompassed by the dashed-line circle on FIG. 9A.

Two HIPping canister endplates were constructed according to the diagram in FIG. 9A and FIG. 9B. The endplates were machined from a 3.5 inch plate of AISI T-304 stainless steel. The endplates were substantially free of surface defects and had a surface roughness of 125 RMS. One of the endplates was machined to include a central bore with a diameter of 1.002 inches. Each endplate weighed about 161 pounds.

Example 2

A HIPping canister according to an embodiment of the present disclosure was made as follows. A 62.75 inch wide sheet of 0.5 inch thick AISI T-304 stainless steel was submerged arc welded to form a cylindrical canister body portion having an outside diameter of 24.28 inch. All welds were made according to the American Society of Mechanical Engineers Boiler and Pressure Vessel Code. The welded side seam was X-ray inspected to ensure integrity. Endplates from Example 1 were TIG welded to each end of the stainless steel cylinder to form a HIPping canister. A 1-inch diameter bore was provided in the center of one of the endplates, while the second endplate was solid and lacked a bore. A 13-inch long T-304 stainless steel tube having a 1.5 inch outside diameter and a 1.0 inch inside diameter was TIG welded to the periphery of the bore to provide a fill stem to allow powder to be introduced into, and air to be removed from, the interior volume of the HIPping canister.

Example 3

Figure 10A:
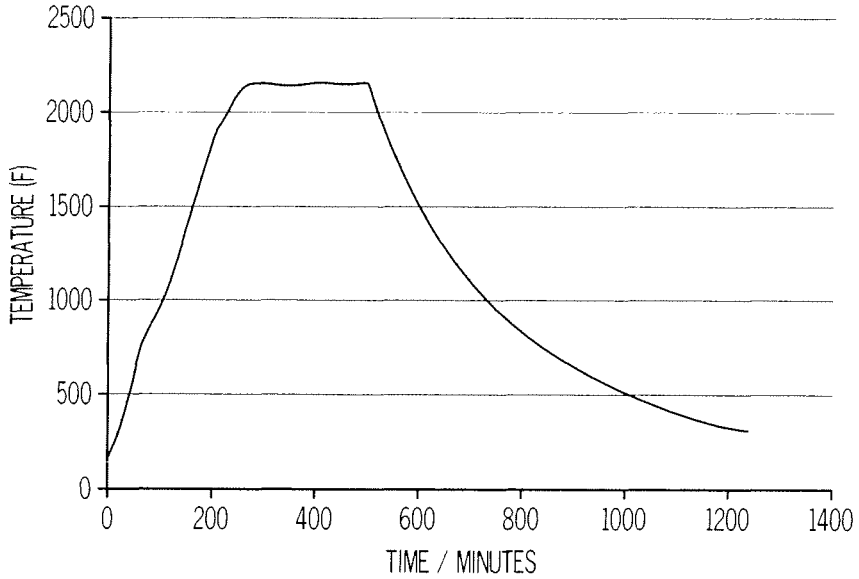
FIG. 10A is a temperature-time plot of a non-limiting embodiment of a HIP process used to consolidate RR1000 nickel-base superalloy powder according to the present disclosure.
Figure 10B:
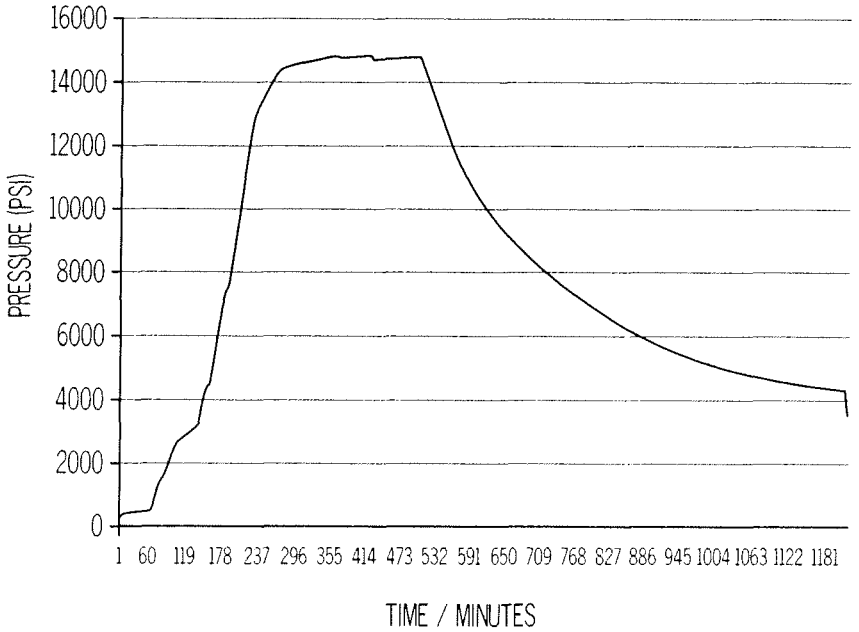
FIG. 10B is a pressure-time plot of a non-limiting embodiment of a HIP process used to consolidate RR1000 nickel-base superalloy powder according to the present disclosure.
Figure 11:
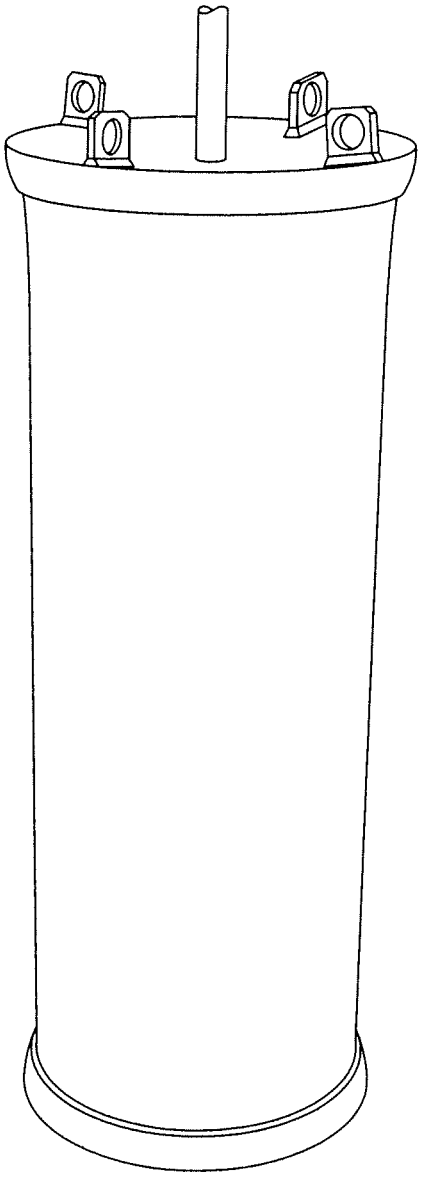
FIG. 11 is a photograph of a HIPped canister according to a non-limiting embodiment of the present disclosure.

The interior volume of the HIPping canister of Example 2 was thoroughly cleaned with abrasive cloth (flap wheel), rinsed with deionized water, and purged through the fill stem. The interior wall of the canister was then electropolished using an electrochemical process, rinsed with deionized water, and dried. After drying, the HIP canister was filled with 5471.5 pounds of RR1000 alloy powder. The powder-filled HIPping canister was placed into a out-gas furnace and evacuated to a pressure of less than 1 Torr, and the fill stem was crimped to hermetically seal the canister. The canister was then placed into a HIP furnace. The HIP furnace was pressurized with argon gas and heated according to the temperature-time plot of FIG. 10A and the pressure-time plot of FIG. 10B. The HIPping canister collapsed and the powder within the canister was consolidated to a solid billet. After HIPping, the HIPping canister and the consolidated billet therein were removed from the HIP furnace and allowed to cool to room temperature. FIG. 11 is a photograph of the HIPping canister including the consolidated RR1000 alloy billet therein after completion of the HIPping process.

Example 4

After HIPping, the HIPped canister including the consolidated billet therein made in Example 3 is cooled to room temperature. The canister may be pickled in hydrochloric or sulfuric acid to dissolve the canister and expose the RR1000 alloy billet. The ends of the alloy billet are flatter than the ends of a like billet made by a HIP process in an identical fashion but using a conventional HIPping canister.

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

What is claimed is:

1. An endplate of a hot isostatic pressing canister, the endplate comprising:

a central region; and a main region extending radially from the central region and terminating in a corner about a periphery of the endplate, the corner including a peripheral lip configured to mate with a body portion of a hot isostatic pressing canister; and a substantially planar outer face;

wherein a thickness of the endplate increases from the central region to the corner and defines a taper angle; and wherein an inner surface of the corner includes a radiused portion by which the main region smoothly transitions into the peripheral lip.

2. The endplate of claim 1, further comprising:

an inner face, wherein the taper angle is defined by an increasing distance between the outer face and the inner face in the main region as a distance from the central region increases.

3. The endplate of claim 2, wherein the peripheral lip comprises a chamfer configured to accept a weld bead for welding the endplate to a body portion of a hot isostatic pressing canister.

4. The endplate of claim 2, further comprising at least one fill stem, wherein the at least one fill stem is configured to enable fluid communication with an interior volume of a hot isostatic pressing canister when the endplate is secured to a body portion of the hot isostatic pressing canister.

5. The endplate of claim 4, wherein the endplate includes only a single fill stem.

6. The endplate of claim 2, wherein the endplate comprises at least one of a low carbon steel, a mild steel, and a stainless steel.

7. The endplate of claim 2, wherein at least a portion of the endplate comprises an electropolished finish.

8. The endplate of claim 2, wherein the endplate is configured to be secured to a cylindrical body portion of a hot isostatic pressing canister.

9. A canister for hot isostatic pressing a powdered material, the canister comprising:

a cylindrical body portion including a circular first end and a circular second end;

a first endplate welded to the circular first end of the cylindrical body portion, the first endplate comprising:

a central region, and a main region extending radially from the central region and terminating in a corner about a periphery of the endplate, the corner including a peripheral lip configured to mate with the body portion, and a substantially planar outer face;

wherein a thickness of the endplate increases from the central region to the corner and defines a taper angle, and wherein an inner surface of the corner includes a radiused portion by which the main region smoothly transitions into the peripheral lip; and a second endplate welded to the circular second end of the cylindrical body portion.

10. The canister for hot isostatic pressing a powdered material of claim 9, wherein the first endplate further comprises:

an inner face, wherein the taper angle is defined by an increasing distance between the outer face and the inner face in the main region as a distance from the central region increases.

11. The canister for hot isostatic pressing a powdered material of claim 9, wherein the peripheral lip of the first endplate further comprises a chamfer configured to accept a weld bead for welding the first endplate to the circular first end of the cylindrical body portion of the canister.

12. The canister for hot isostatic pressing a powdered material of claim 9, wherein the first endplate further comprises at least one fill stem, wherein the at least one fill stem is configured to enable fluid communication with an interior volume of the canister when the first endplate is welded to the circular first end of the cylindrical body portion of the canister.

13. The canister for hot isostatic pressing a powdered material of claim 12, wherein the first endplate includes only a single fill stem.

14. The canister for hot isostatic pressing a powdered material of claim 9, wherein the first endplate comprises at least one of a low carbon steel, mild steel, and a stainless steel.

15. The canister for hot isostatic pressing a powdered material of claim 9, wherein at least a portion of the first endplate comprises an electropolished finish.

16. The canister for hot isostatic pressing a powdered material of claim 9, wherein the second endplate comprises:

a central region; and a main region extending radially from the central region and terminating in a corner about a periphery of the endplate, the corner including a peripheral lip configured to mate with a body portion of the canister; and a substantially planar outer face;

wherein a thickness of the endplate increases from the central region to the corner and defines a taper angle; and wherein an inner surface of the corner includes a radiused portion by which the main region smoothly transitions into the peripheral lip.

17. The canister for hot isostatic pressing a powdered material of claim 16, wherein the second endplate further comprises:

an inner face, wherein the taper angle is defined by an increasing distance between the outer face and the inner face in the main region as a distance from the central region increases.

* * * * *